United States Patent [19]

Papay

[11] 4,356,097

[45] * Oct. 26, 1982

[54] ALKYLPHOSPHONATE LUBRICATING OIL

[75] Inventor: Andrew G. Papay, Manchester, Mo.

[73] Assignee: Edwin Cooper, Inc., St. Louis, Mo.

[ * ] Notice: The portion of the term of this patent subsequent to Jun. 19, 1996, has been disclaimed.

[21] Appl. No.: 11,141

[22] Filed: Feb. 12, 1979

Related U.S. Application Data

[63] Continuation-in-part of Ser. No. 891,591, Mar. 30, 1978, Pat. No. 4,158,633.

[51] Int. Cl.[3] ..... C10M 1/48; C10M 3/42

[52] U.S. Cl. ..... 252/33.4; 252/49.8; 252/32.7 E

[58] Field of Search ..... 252/32.7 E, 33, 33.4, 252/49.8; 260/961

[56] References Cited

U.S. PATENT DOCUMENTS

| | | | |
|---|---|---|---|
| 2,174,019 | 9/1939 | Sullivan | 252/49.8 |
| 2,274,291 | 2/1942 | Clayton et al. | 252/49.8 |
| 2,397,422 | 3/1946 | Kosolapoff | 260/961 |
| 2,436,141 | 2/1948 | Goebel | 260/961 |
| 3,206,401 | 9/1965 | O'Halloran | 252/49.8 X |
| 3,702,824 | 11/1972 | Schlicht | 252/49.8 |
| 4,158,633 | 6/1979 | Papay | 252/49.8 X |
| 4,228,020 | 10/1980 | Papay | 252/49.8 X |

FOREIGN PATENT DOCUMENTS

| | | | |
|---|---|---|---|
| 1247541 | 9/1971 | United Kingdom | 252/49.8 |

*Primary Examiner*—Thomas A. Waltz

*Attorney, Agent, or Firm*—Donald L. Johnson; John F. Sieberth; Joseph D. Odenweller

[57] ABSTRACT

Engine crankcase lubricating oil containing a dihydrocarbyl hydrocarbylphosphonate (e.g. diethyl octadecylphosphonate) exhibits reduced friction which results in an increase in gasoline mileage thus conserving energy.

6 Claims, No Drawings

ALKYLPHOSPHONATE LUBRICATING OIL

CROSS REFERENCE TO RELATED APPLICATION

This application is a continuation-in-part of application Ser. No. 891,591, filed Mar. 30, 1978, now U.S. Pat. No. 4,158,633.

BACKGROUND OF THE INVENTION

In order to conserve energy, automobiles are now being engineered to give improved gasoline mileage compared to those in recent years. This effort is of great urgency as a result of Federal regulations recently enacted which compel auto manufacturers to achieve prescribed gasoline mileage. These regulations are to conserve crude oil. In an effort to achieve the required mileage, new cars are being down-sized and made much lighter. However, there are limits in this approach beyond which the cars will not accommodate a typical family.

Another way to improve fuel mileage is to reduce engine friction. The present invention is concerned with this latter approach.

SUMMARY OF THE INVENTION

According to the present invention a lubricating oil containing a phosphonate additive is supplied for use in the crankcase of internal combustion engines. This new oil exhibits reduced friction and gives better fuel economy compared to the same fuel without the additive. The additive is a dihydrocarbyl hydrocarbylphosphonate.

Phosphonate additives have been used in lubricating oil compositions in the past. For example, British Pat. No. 1,247,541 discloses phosphonates in gear oil and automatic transmission fluids. Other references relating to their use are U.S. Pat. Nos. 2,174,019; 2,274,291; 2,397,422; 2,436,141 and 2,957,931.

DESCRIPTION OF THE PREFERRED EMBODIMENTS

A preferred embodiment of the invention is an internal combustion engine crankcase lubricating oil composition having a lubricating viscosity, said composition comprising a major amount of a lubricating oil and a minor friction-reducing amount of a phosphonate or mixture of phosphonates having the formula

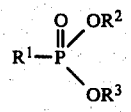

wherein $R^1$ is an alkyl or alkenyl group containing about 12–30 carbon atoms and $R^2$ and $R^3$ are lower alkyl groups containing 1–4 carbon atoms, at least 5 mole percent of said lower alkyl groups containing 2–4 carbon atoms. More preferably, at least 10 mole percent of said lower alkyl groups contain 2–4 carbon atoms.

Examples of these phosphonates are diethyl triacontylphosphonate, di-n-propyl triacontenylphosphonate, ethyl isobutyl eicosylphosphonate, diethyl hexadecylphosphonate, diethyl hexadecenylphosphonate, methyl ethyl tetracontenylphosphonate, diethyl hexacontylphosphonate, diisobutyl dodecylphosphonate, methyl isopropyl dodecenylphosphonate and the like.

In a more preferred embodiment $R^1$ is an alkyl or alkenyl group containing about 16–20 carbon atoms. Examples of these more preferred phosphonates are diethyl hexadecylphosphonate, diethyl hexadecenylphosphonate, diethyl octadecylphosphonate, methyl ethyl octadecenylphosphonate, diisobutyl eicosylphosphonate, diisopropyloctadecylphosphonate and the like.

A preferred additive is diethyl octadecylphosphonate.

The phosphonates are added to the lubricating oil in an amount which reduces the friction of the engine operating with the oil in the crankcase. A useful concentration is about 0.05–3 wt. %. A more preferred range is about 0.2–1.5 wt %.

From the above it can be seen that the present invention provides an improved crankcase lubricating oil. Accordingly, an embodiment of the invention is an improved motor oil composition formulated for use as a crankcase lubricant in an internal combustion engine wherein the improvement comprises including in the crankcase oil an amount sufficient to reduce fuel consumption of the engine of a di-lower alkyl $C_{12-30}$ hydrocarbylphosphonate or mixture thereof wherein said lower alkyl groups contain 1–4 carbon atoms, at least 5 mole percent of said lower alkyl groups containing 2–4 carbon atoms.

In a highly preferred embodiment such improved motor oil also contains an ashless dispersant, a zinc dialkyldithiophosphonate and an alkaline earth metal salt of a petroleum sulfonic acid or an alkaryl sulfonic acid (e.g. alkylbenzene sulfonic acid).

The additives can be used in mineral oil or in synthetic oils of viscosity suitable for use in the crankcase of an internal combustion engine. Crankcase lubricating oils have a viscosity up to about 80 SUS at 210° F. According to the present invention di-lower alkyl $C_{12-30}$ hydrocarbylphosphonates function to increase fuel economy when added to lubricating oil compositions formulated for use in the crankcase of internal combustion engines. Similar mileage benefits could be obtained in both spark ignited and diesel engines.

Crankcase lubricating oils of the present invention have a viscosity up to about SAE 40. Sometimes such motor oils are given a classification at both 0° and 210° F., such as SAE 10 W 40 or SAE 5 W 30.

Crankcase lubricants of the present invention can be further identified since they usually contain a zinc dihydrocarbyl dithiophosphate in addition to the phosphonate additive. Likewise, these crankcase lubricants contain an alkaline earth metal sulfonate such as calcium petroleum sulfonate, calcium alkaryl sulfonate, magnesium petroleum sulfonate, magnesium alkaryl sulfonate, barium petroleum sulfonate, barium alkaryl sulfonate and the like.

Mineral oils include those of suitable viscosity refined from crude oil from all sources including Gulfcoast, midcontinent, Pennsylvania, California, Alaska and the like. Various standard refinery operations can be used in processing the mineral oil.

Synthetic oil includes both hydrocarbon synthetic oil and synthetic esters. Useful synthetic hydrocarbon oils include liquid polymers of $\alpha$-olefins having the proper viscosity. Especially useful are the hydrogenated liquid oilgomers of $C_{6-12}$ $\alpha$-olefins such as $\alpha$-decene trimer. Likewise, alkylbenzenes of proper viscosity can be used, such as didodecylbenzene.

Useful synthetic esters include the esters of both monocarboxylic acid and polycarboxylic acid as well as monohydroxy alkanols and polyols. Typical examples are didodecyl adipate, trimethylol propane tripelargonate, pentaerythritol tetracaproate, di-(2-ethylhexyl)adipate, dilauryl sebacate and the like. Complex esters prepared from mixtures of mono- and dicarboxylic acid and mono- and polyhydroxyl alkanols can also be used.

Blends of mineral oil with synthetic oil are particularly useful. For example, blends of 10–25 wt % hydrogenated α-decene trimer with 75–90 wt % 150 SUS (100° F.) mineral oil results in an excellent lubricant. Likewise, blends of about 10–25 wt % di-(2-ethylhexyl-)adipate with mineral oil of proper viscosity results in a superior lubricating oil. Also blends of synthetic hydrocarbon oil with synthetic esters can be used. Blends of mineral oil with synthetic oil are especially useful when preparing low viscosity oil (e.g. SAE 5 W 20) since they permit these low viscosities without contributing excessive volatility.

The more preferred lubricating oil composition includes zinc dihydrocarbyldithiophosphate in combination with the dihydrocarbyl hydrocarbyl phosphonate. When these additives are used in combination very significant increases in fuel economy have been achieved. Both zinc dialkyldithiophosphates and zinc dialkaryldithiophosphates as well as mixed alkyl-aryl dithiophosphates can be used. Examples of these are zinc dihydrocarbyldithiophosphate in which the hydrocarbyl groups are a mixture of isobutyl and isoamyl alkyl groups. Likewise, zinc dinonylphenyldithiophosphate can be used with good results. Good results are achieved using sufficient zinc dihydrocarbyldithiophosphate to provide about 0.01–0.5 wt % zinc. A preferred concentration supplies about 0.05–0.3 wt % zinc.

Another additive used in the oil compositions are the alkaline earth metal petroleum sulfonate or alkaline earth metal alkaryl sulfonates. Examples of these are calcium petroleum sulfonates, magnesium petroleum sulfonates, barium alkaryl sulfonates, calcium alkaryl sulfonates or magnesium alkaryl sulfonates. Both the neutral and the overbased sulfonates having base numbers up to about 400 can be beneficially used. These are used in an amount to provide about 0.05–1.5 wt % alkaline earth metal and more preferably about 0.1–1.0 wt %. In a most preferred embodiment the lubricating oil composition contains a calcium petroleum sulfonate or alkaryl (e.g. alkylbenzene) sulfonate. Such calcium sulfonates used in combination with the phosphonates described herein give better fuel economy than is obtained with the similar magnesium sulfonates.

Viscosity index improvers can be included such as the polyalkylmethacrylate type or the ethylene-propylene copolymer type. Likewise, styrene-diene VI improvers or styrene-acrylate copolymers can be used. Alkaline earth metal salts of phosphosulfurized polyisobutylene are useful.

Most preferred crankcase oils also contain an ashless dispersant such as the polyolefin substituted succinamides and succinimides of polyethylene polyamines such as tetraethylenepentamine. The polyolefin succinic substituent is preferably a polyisobutene group having a molecular weight of from about 800 to 5,000. Such ashless dispersants are more fully described in U.S. Pat. Nos. 3,172,892 and 3,219,666 incorporated herein by reference.

Another useful class of ashless dispersants are the polyolefin succinic esters of mono- and polyhydroxy alcohols containing 1 to about 40 carbon atoms. Such dispersants are described in U.S. Pat. Nos. 3,381,022 and 3,522,179.

Likewise, mixed ester/amides of polyolefin substituted succinic acid made using alkanols, amines and/or aminoalkanols represent a useful class of ashless dispersants.

The succinic amide, imide and/or ester type ashless dispersants may be boronated by reaction with a boron compound such as boric acid. Likewise the succinic amide, imide, and/or ester may be oxyalkylated by reaction with an alkylene oxide such as ethylene oxide or propylene oxide.

Other useful ashless dispersants include the Mannich condensation products of polyolefin-substituted phenols, formaldehyde and polyethylene polyamine. Preferably, the polyolefin phenol is a polyisobutylene-substituted phenol in which the polyisobutylene group has a molecular weight of from about 800 to 5,000. The preferred polyethylene polyamine is tetraethylene pentamine. Such Mannich ashless dispersants are more fully described in U.S. Pat. Nos. 3,368,972; 3,413,347; 3,442,808; 3,448,047; 3,539,633; 3,591,598; 3,600,372; 3,634,515; 3,697,574; 3,703,536; 3,704,308; 3,725,480; 3,726,882; 3,736,357; 3,751,365; 3,756,953; 3,793,202; 3,798,165; 3,798,247 and 3,803,039.

The above Mannich dispersants can be reacted with boric acid to form boronated dispersants having improved corrosion properties.

Tests were carried out which demonstrate the friction-reducing properties of the additives when used in a formulated crankcase motor oil in an internal combustion engine. These tests have been found to correlate with fuel economy tests in automobiles. In these tests an engine with its cylinder head removed and with the test lubricating oil in its crankcase was brought to 1800 rpm by external drive. Crankcase oil was maintained at 63° C. to simulate engine operating conditions. The external drive was disconnected and the time to coast to a stop was measured. This was repeated several times with the base oil and the same oil containing one percent of diethyl octadecylphosphonate. The base oil was a fully formulated commercial oil containing polyisobutyl succinimide of an ethylene polyamine and an overbased calcium alkarylsulfonate. The addition of diethyl octadecylphosphonate increased coast-down time by 2.7 percent.

I claim:

1. In a motor oil composition formulated for use as a crankcase lubricant for internal combustion engines, said formulated oil containing an ashless dispersant, the improvement comprising including in said composition an amount sufficient to reduce fuel consumption of said engine of a di-ethyl $C_{12-30}$ alkylphosphonate, said improvement functioning to reduce fuel consumption of an internal combustion engine when said motor oil composition is used as the crankcase lubricating oil in said engine.

2. A composition of claim 1 wherein said di-lower alkyl alkylphosphonate is di-ethyl octadecylphosphonate.

3. An improved oil composition of claim 1 containing a detergent amount of an oil-soluble alkaline earth metal salt of a petroleum sulfonic acid or an alkaryl sulfonic acid.

4. An improved motor oil composition of claim 3 wherein said alkaline earth metal is calcium.

5. An improved motor oil composition of claim 4 wherein said di-ethyl $C_{12-30}$ alkylphosphonate is di-ethyl octadecylphosphonate.

6. A method for improving the fuel economy of an internal combustion engine, said method comprising placing in the crankcase of said engine a lubricating oil formulated for use as a crankcase lubricant containing an ashless dispersant and an amount sufficient to reduce fuel consumption of said engine of a di-ethyl $C_{12-30}$ alkylphosphonate.

* * * * *